US005492526A

United States Patent [19]

Chen

[11] Patent Number: 5,492,526

[45] Date of Patent: Feb. 20, 1996

[54] LOOP DEVICE FOR EXERCISE AND MASSAGE PURPOSES

[76] Inventor: Yu-Chin Chen, No. 29, Lane 465, Lieng Tsuen Road, Fong Yuen City, Taichung Hsien, Taiwan

[21] Appl. No.: 323,124

[22] Filed: Oct. 14, 1994

[51] Int. Cl.[6] ..... A61H 15/00

[52] U.S. Cl. ..... 601/132; 601/118; 446/236

[58] Field of Search ..... 63/3, 5.1, 4, 2; 446/236, 219, 486, 490; D11/3–11; 128/898; 601/118, 84, 128–132

[56] References Cited

U.S. PATENT DOCUMENTS

| | | | |
|---|---|---|---|
| D. 263,288 | 3/1982 | Errigo | D11/8 |
| D. 292,180 | 10/1987 | Seraile | D11/3 X |
| 806,482 | 12/1905 | Moore | 601/132 |
| 1,190,831 | 7/1916 | Werner | 63/2 X |
| 1,245,965 | 11/1917 | Pratt | 446/119 X |
| 1,702,991 | 2/1929 | Bechmann | 601/132 |
| 3,170,311 | 2/1965 | Raphael | 63/2 |
| 3,303,539 | 2/1967 | White | 63/3 |
| 3,957,039 | 5/1976 | Ehren | 601/132 |
| 3,960,144 | 6/1976 | Simjian | 601/132 |
| 4,052,982 | 10/1977 | Ozeryansky | 446/236 X |
| 4,753,086 | 6/1988 | Schmidt | 63/3 |
| 5,018,250 | 5/1991 | Schröder | 63/4 X |
| 5,054,299 | 10/1991 | Maveety | 63/3 |

FOREIGN PATENT DOCUMENTS

| | | | |
|---|---|---|---|
| 814881 | 7/1937 | France | 601/132 |
| 26682 | 11/1912 | United Kingdom | 601/132 |

OTHER PUBLICATIONS

"Ross–Simons", Spring 1990, p. 8, #8D–32.

"Calstar" Classic Jewelry Statements, Fall 1987 H. Bead Necklace—p. 5: [#129–42].

*Primary Examiner*—Robert A. Hafer

*Assistant Examiner*—Brian E. Hanlon

*Attorney, Agent, or Firm*—Charles E. Baxley

[57] ABSTRACT

A loop device includes an endless thread threaded through a number of balls, and a number of spacers disposed between the balls. The balls may apply force against human body for exercising and massaging purposes. The endless thread includes a wire cable for preventing stretching of the endless thread, and a soft covering engaged on the wire cable. The soft covering is engaged between the wire cable and the balls for reducing friction between the wire cable and the balls and for reducing noise.

1 Claim, 2 Drawing Sheets

LOOP DEVICE FOR EXERCISE AND MASSAGE PURPOSES

BACKGROUND OF THE INVENTION

1. Field of the Invention

The present invention relates to a loop device, and more particularly to a loop device for exercise and massage purposes.

2. Description of the Prior Art

Typical roller massage devices comprise a looped extensible elongated member with spaced rollers mounted rotatably on the extensible elongated member. The device is provided for engaging with a human body for massaging the body. Two handles are required to be engaged with the member for moving the member up and down along the body. However, it is inconvenient for the users to move the handles with hands, i.e., the member can not be easily moved by hands. In addition, the member is engaged with the body such that the member can not be used for exercise purposes.

The present invention has arisen to mitigate and/or obviate the afore-described disadvantages of the conventional exercise devices.

SUMMARY OF THE INVENTION

The primary objective of the present invention is to provide a device which can be used for both exercising and massaging purposes and which includes a thread member that may be prevented from stretching, such that the device includes a configuration having longer working life.

In accordance with one aspect of the invention, there is provided a loop device for exercise and massage purposes. The loop device comprises an endless thread threaded through a number of balls, and a number of spacers disposed between the balls. The balls may apply force against human body for exercising and massaging purposes. The endless thread includes a wire cable for preventing stretching of the endless thread, and a soft covering engaged on the wire cable. The soft covering is engaged between the wire cable and the balls for reducing friction between the wire cable and the balls and for reducing noise.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
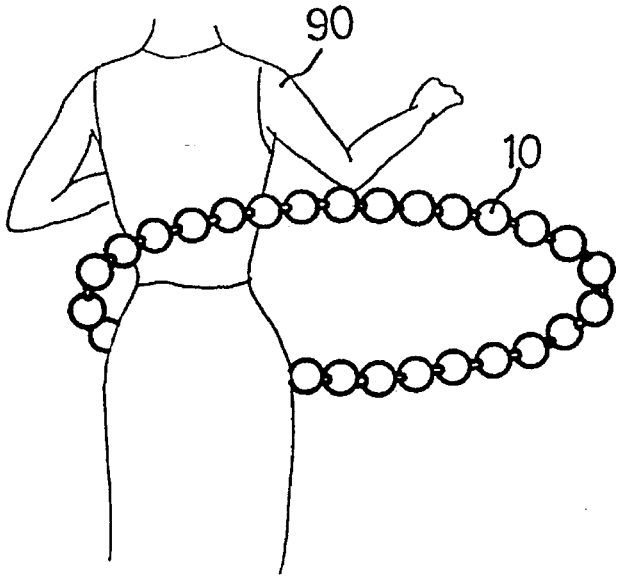
FIG. 1 is a perspective view illustrating the application of an exercise and massage device in accordance with the present invention.
Figure 4:
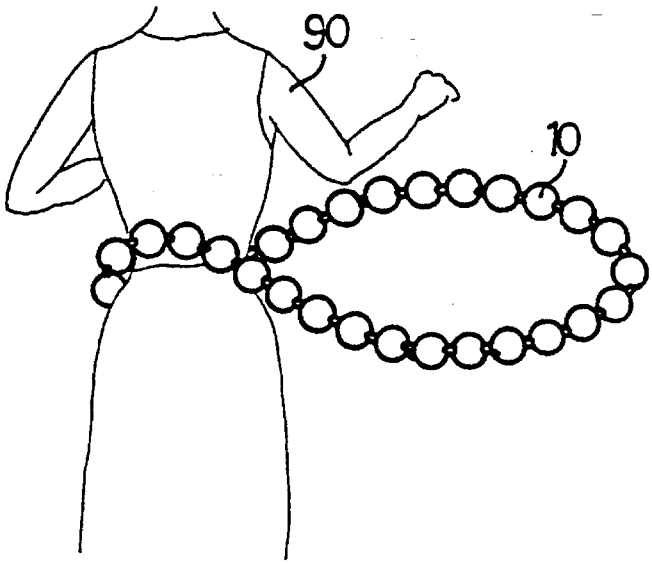
FIG. 4 is a perspective view similar to FIG. 1, illustrating the other application of the device.

Referring to the drawings, a loop device for exercise and massage purposes in accordance with the present invention comprises a number of ball members 10 each having a hole

11 formed therein, a thread member 20 engaged through the holes 11 of the ball members 10 for coupling the ball members 10 together so as to form a loop member. The thread member 20 includes two end portions fixed together so as to form the endless loop member. A number of spacing members 30 are provided between the ball members 10 for spacing the ball members. The device can be used as an exercising hoop for exercising human body. In addition, the ball members 10 may apply force against the human body for massaging purposes and for slimming human body. The primary configuration of the loop device is disclosed in a co-pending U.S. patent application, the Ser. No. thereof is 08/282,645, filed Jul. 29, 1994. The co-pending patent application is taken as a reference.

Figure 2:
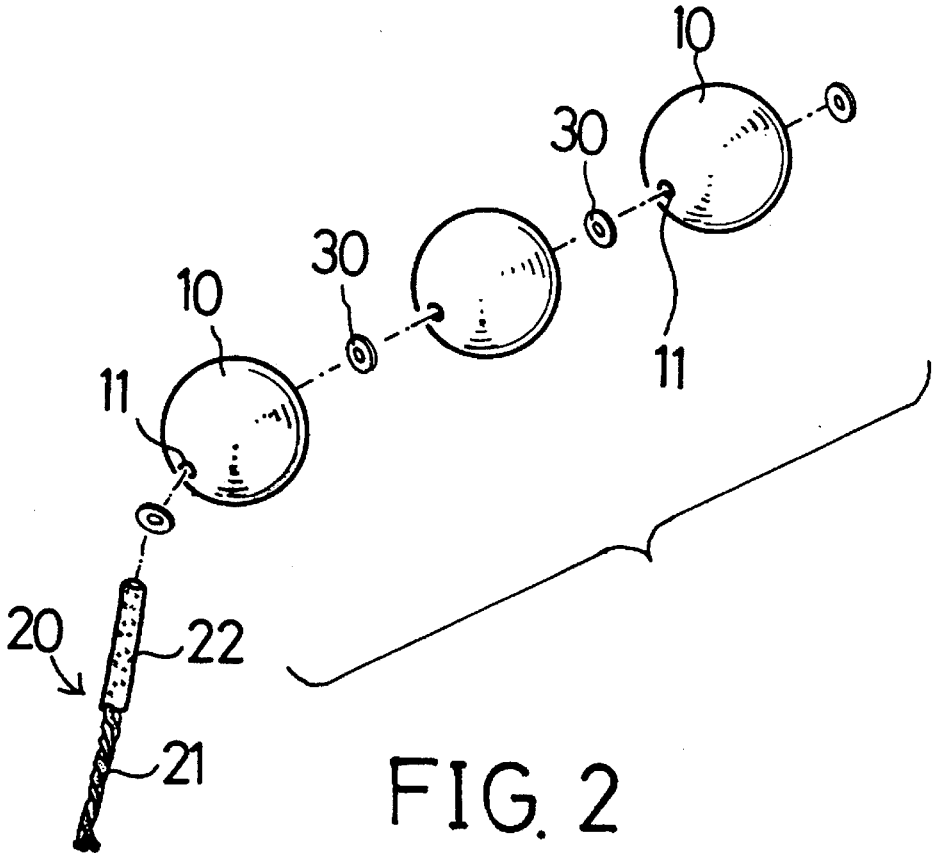
FIG. 2 is a partial exploded view of the device.
Figure 3:
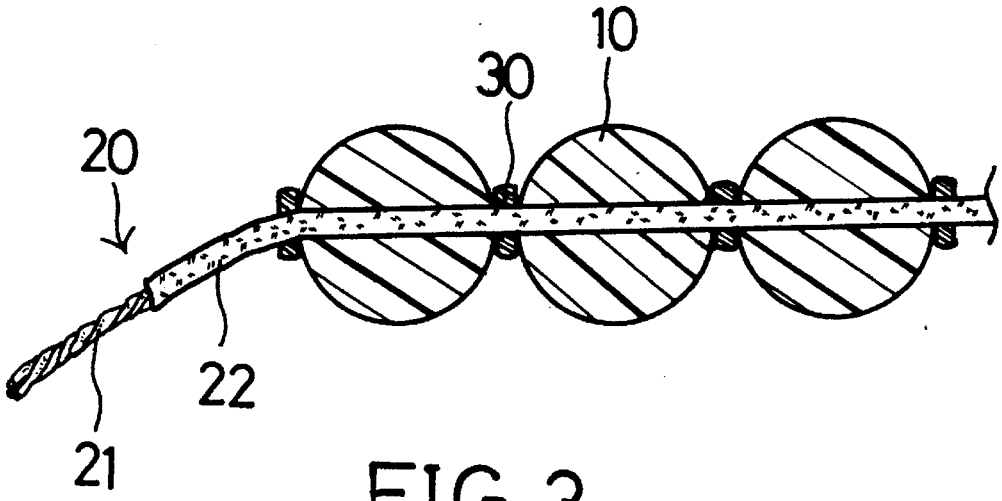
FIG. 3 is a partial cross sectional view of the device.

As best shown in FIGS. 2 and 3, the thread member 20 includes a wire cable 21 having a covering 22 of soft materials, such as woven cotton materials. The wire cable 21 includes an excellent tensile strength such that the wire cable 21 will not be extended or stretched after using and such that the ball members 10 will not be separated from each other. When the ball members 10 are separated from each other or become loose, the users may not easily operate the loop device. The soft covering 22 is engaged between the wire cable 21 and the ball members 10 so as to reduce friction between the cable and the ball members. Without the soft covering 22, great noise may be generated when the ball members 10 are slidably engaged with the wire cable 21, such that the soft covering 22 may further be provided to reduce noise.

Accordingly, the loop device in accordance with the present invention includes a configuration excellent for both exercising and massaging purposes and having longer working life.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for exercise and massage comprising steps as follows:

providing an exercise and massage device comprising an endless thread member which includes a wire, a plurality of ball members threaded on said thread member, a plurality of spacing members provided between said ball members, said thread member including a wire cable for preventing its stretching, and a soft covering engaged on said wire cable, said soft covering engaging between said wire cable and said ball members for reducing friction therebetween;

encircling a torso with the exercise and massage device and gyrating said torso whereby the ball members apply force against a user's body for exercising and massaging purposes.

* * * * *